US008116490B2

(12) United States Patent
Puder et al.

(10) Patent No.: US 8,116,490 B2
(45) Date of Patent: Feb. 14, 2012

(54) METHOD FOR OPERATION OF A HEARING DEVICE SYSTEM AND HEARING DEVICE SYSTEM

(75) Inventors: Henning Puder, Erlangen (DE); Tobias Rosenkranz, Erlangen (DE)

(73) Assignee: Siemens Audiologische Technik GmbH, Erlangen (DE)

( * ) Notice: Subject to any disclaimer, the term of this patent is extended or adjusted under 35 U.S.C. 154(b) by 850 days.

(21) Appl. No.: 12/221,937

(22) Filed: Aug. 7, 2008

(65) Prior Publication Data

US 2009/0041272 A1 Feb. 12, 2009

(30) Foreign Application Priority Data

Aug. 9, 2007 (DE) ..... 10 2007 037 659

(51) Int. Cl.
*H04R 25/00* (2006.01)

(52) U.S. Cl. ..... 381/318; 381/93; 381/108

(58) Field of Classification Search ..... 381/318, 381/93, 108

See application file for complete search history.

(56) References Cited

U.S. PATENT DOCUMENTS

2001/0053229 A1* 12/2001 Azizi ..... 381/94.1
2002/0176594 A1* 11/2002 Hohmann et al. ..... 381/312

FOREIGN PATENT DOCUMENTS

DE 101 10 258 C1 8/2002

OTHER PUBLICATIONS

Grimm et al.,"Combinations of monaural and binaural feedback control algorithms increase added stable gain", IHCON 2006, pp. 1-4.
Grimm et al., "Increase and Subjective Evaluation of Feedback Stability in Hearing Aids by a Binaural Coherence-Based Noise Reduction Scheme", IEEE Transactions on Audio, Speech, and Language Processing, vol. 17, No. 7, Sep. 2009, p. 1408-1419.
Communication/Invention Disclosure citing listed references, Dec. 8, 2006, pp. 1-9.

* cited by examiner

*Primary Examiner* — Tu-Tu Ho

(57) ABSTRACT

There is described a method for operation of a hearing device system with two microphones arranged spatially separated from one another and with sound-generating output units assigned to these microphones, in which, by comparison of the microphone signals or of signals derived therefrom, feedback is detected, and on detection of the feedback measures are initiated for reducing the feedback, and with the comparison of the microphone signals or of signals derived therefrom comprising a frequency-selective power comparison. There is also described a hearing device system suitable for this method.

16 Claims, 4 Drawing Sheets

METHOD FOR OPERATION OF A HEARING DEVICE SYSTEM AND HEARING DEVICE SYSTEM

CROSS REFERENCE TO RELATED APPLICATIONS

This application claims priority of German application No. 10 2007 037 659.8 DE filed Aug. 9, 2007, which is incorporated by reference herein in its entirety.

FIELD OF INVENTION

The invention relates to a method for operation of a hearing device system with at least two microphones arranged spatially separated from each other and sound-generating output units assigned to these microphones, as is especially the case in binaural hearing device systems. The invention further relates to a hearing device system for carrying out the method.

BACKGROUND OF INVENTION

Hearing devices are designed to be used as medical aids to enable patients with hearing damage to hear as naturally as possible. In such cases care must be taken to suppress as completely as possible any interference noise caused by the technology involved. Such interference noise especially includes whistling noises caused by acoustic feedback. Acoustic feedback of this nature occurs especially with hearing device systems when said systems are operating with high amplification and are caused by oscillations at a specific frequency fed back to the microphone (feedback). In some cases whistling caused in this way is so loud that it is even perceived as disturbing in the vicinity of a hearing device wearer.

A whistling caused by feedback can occur whenever sound, which is picked up by a microphone of a hearing device, is amplified by a corresponding amplifier and output again via a sound-generating output unit, for example via the earpiece of a hearing device. In such cases the output sound might reach the microphone again and be further amplified. Two conditions must thus be fulfilled for feedback-induced whistling to occur. The sound amplification must be greater than the attenuation of the sound on the way from the sound-generating output unit back to the microphone. In addition the phase shift at the microphone between the sound originally picked up by the microphone and the sound sent out by the sound-generating output unit must correspond to $2\Pi$ or any given multiple thereof. There are numerous possible ways of countering the occurrence of feedback-induced whistling in hearing devices or hearing device systems by influencing these two conditions. One possibility consists of limiting the hearing device amplification, but, especially with a serious hearing impairment of the hearing aid wearer, this results in the function of the hearing device system overall being reduced ad absurdum.

Another known method is to reduce the loop amplification of a hearing device system or hearing device, that is the product of the hearing device amplification and the attenuation of the feedback path, during an adaptation of the hearing device by setting a so-called notch filter (narrowband blocking filter) in frequency ranges in which there is likely to be an occurrence of feedback. Since however especially the characteristic of the feedback path set is in some cases strongly dependent on the ambient conditions, the occurrence of acoustic feedback can in some cases not be safely avoided with such notch filters since their frequencies cannot be reliably predicted.

Methods are also known that are able, by a dynamic reduction of feedback oscillations, to adjust themselves automatically to different feedback situations and which are intended to take care of a corresponding suppression of these types of oscillation. So-called compensation algorithms are known, which with the aid of adaptive filters estimate the feedback component in a microphone signal and neutralize it by subtraction. In this way the hearing device amplification is not adversely affected and is available in its full capacity for the amplification of useful signals. A weakpoint of known compensation methods is the precision of the estimation of the proportion of the feedback signal. They are suitable for the separation of wideband input signals of feedback-induced oscillations. Tonal input signals however will however in some cases be interpreted as feedback-induced oscillation. As a result of an estimation of the feedback component in the microphone signal which is thus inevitably incorrect, the tonal input signal actually arriving as the useful signal can itself be subtracted.

The use of algorithms which become active after the detection of apparent feedback-induced oscillations is also known. In such cases the microphone signal is continuously monitored. After detection of an oscillation indicating feedback the amplification of the hearing device is reduced to a point at which the loop amplification falls below a critical limit. This reduction of the amplification can be undertaken by reducing the amplification within a specific frequency channel or can include the activation of a corresponding blocking filter. The disadvantage of such methods however is likewise that conventional oscillation detectors cannot distinguish between feedback-induced oscillations on the one hand and tonal narrowband input signals on the other hand. As a result tonal narrowband input signals can activate algorithms intended for the suppression of the feedback-induced oscillations and thereby themselves help to suppress their amplification.

A further known practice, especially in binaural hearing device systems, is to compare incoming microphone signals in order to contribute to distinguishing between feedback-induced oscillations and the useful signals that are in some cases similar to these oscillations (DE 10110258C1). This invention starts from the assumption that in binaural systems, on the one hand the amplification of the individual hearing device components will be set differently because of the adaptation to individual hearing damage, and on the other hand, by relatively small variations of the arrangement of the hearing device components at the ear of a wearer as well as by numerous ambient conditions in the vicinity of the hearing device wearer, different levels of attenuation of the individual feedback paths will be produced. For this reason it cannot be reckoned that spontaneously occurring feedback-induced oscillations will occur at both hearing device components at the same frequency. An incoming useful signal on the other hand will always be present almost simultaneously and with the same frequency at both components of a binaural hearing device system. By a comparison of the generated microphone signals using a so-called coherence analysis, an attempt is made to interpret signals with high coherence as useful signals and signals with low coherence as feedback-induced oscillations. A disadvantage of this method however lies in the fact that with a constant occurrence of feedback-induced oscillations at a component of a binaural hearing device system, this will be coupled-in after short time via the sound-generating output device into the microphone of the other component of the binaural hearing device system as well if the sound generated by the feedback-induced oscillations is emitted sufficiently loudly by the oscillating components. A coherence analysis inevitably produces a high level of coherence for these types of generated signals. This means that the signals will be interpreted as incoming useful signals. The misinterpretation results in no measures being undertaken to suppress the feedback-induced whistling.

SUMMARY OF INVENTION

An object of the present invention is to specify a facility for operating a hearing device system, with feedback-induced oscillations being safely detected and avoided, without in this case having to perceptibly reduce the functionality of the hearing device system.

The object is achieved by a method with the features of a first independent claim, with subclaims specifying advantageous embodiments of such a method, and by a hearing device system which is suitable for carrying out the method.

The invention may relate to the core problems of avoiding feedback: Safe detection or avoidance of artifacts, speed of adaptation and optimum parameter discovery for algorithms for suppressing, avoiding or compensating for feedback-induced oscillations.

The invention can be employed for all hearing device systems which have at least two microphones and at least two sound-generating output units. In accordance with the invention microphone signals of at least two microphones arranged spaced at a distance from one another are compared. Through an analysis and the comparison of the microphone signals or of signals derived therefrom a distinction between feedback and useful signals is possible, even if these useful signals are similar to the feedback as regards the degree of coherence.

A further object of the invention is thus a preferably binaural method for feedback suppression, one of the uses of which is to control an adaptive compensation filter in the frequency range in which feedback can be identified, with the method not operating on the basis of a coherence function but using as its starting point an intelligent frequency-dependent output comparison of the microphone signals of the two hearing devices. This method of operation is far superior to the known coherence method. One of the reasons for this is that on the one hand microphone signals can be incoherent because of head shadowing effects in many frequency components, even if they are not attributable to feedback, which leads to undesired signal attenuations. On the other hand, with feedback whistling worked out after a short time, the frequency components at which feedback occurs are especially coherent since they can be received by both microphones. The reason is the acoustic coupling between the hearing devices which is not completely excluded by head shadowing effects.

Consequently the invention relates to a method for operation of a hearing device system with at least two microphones arranged at a distance from each other and to sound-generating output units assigned to these microphones, in which by comparison of the microphone signals or of signals derived from them, feedback is detected, and for recognized feedback measures are taken to reduce the feedback, with the comparison of the microphone signals or of signals derived from them including a frequency-selective power comparison.

At least one quantitative signal or a signal able to be evaluated quantitatively which indicates the feedback and its frequency is generated by the frequency-selective power comparison. Advantageously this is done by the frequency-selective power comparison being conducted by the difference between the spectrums of the two microphone signals being formed, this difference being subjected to an offset correction and being evaluated in respect of a threshold value. The evaluation in respect of the threshold values is undertaken for example so that values below the threshold are truncated, whereas values above the threshold are included uncorrupted in further signal processing.

The method of operation contains a normalization of the spectral values to the power and thereby the inclusion of the spectral environment of the oscillation frequencies in its evaluation.

BRIEF DESCRIPTION OF THE DRAWINGS

The invention is explained in greater detail with reference to exemplary embodiments. The figures show.

DETAILED DESCRIPTION OF INVENTION

Figure 1:
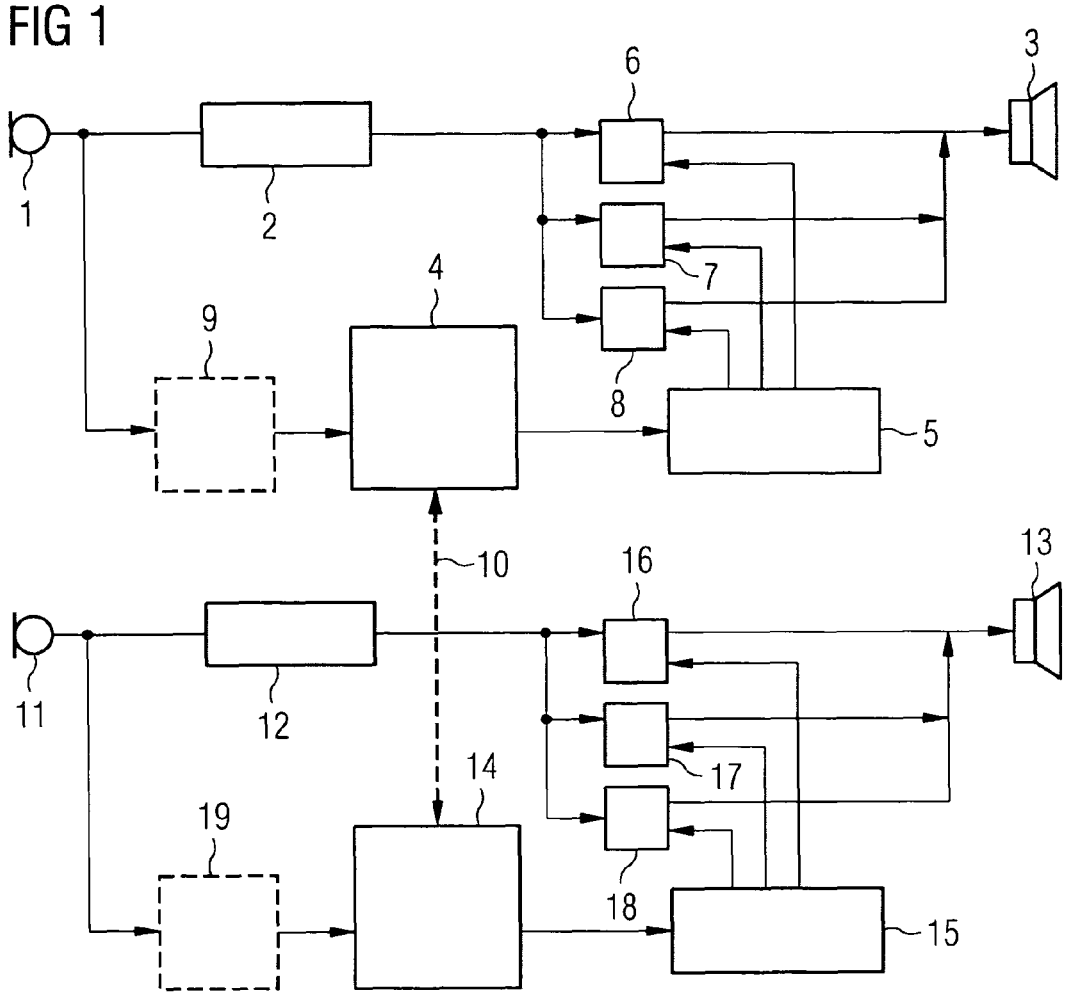
FIG. 1 a binaural hearing device system which is suitable for the inventive avoidance of feedback.

FIG. 1 shows a binaural hearing device system which is suitable for inventive avoidance of feedback. This consists of two components identical in design to be worn close to the ear, each of which has a microphone 1, 11, a signal processing unit 2, 12 and also a loudspeaker 3, 13. Microphone 1, 11, signal processing unit 2, 12, and loudspeaker 3, 13 for a signal amplification path, with their modules and their signal processing components via which different algorithms can be implemented for signal processing being able to be integrated into the signal processing unit 12. Incoming microphone signals are forwarded amplified to the loudspeakers 3, 13. If sound output via the loudspeakers 3, 13 gets back to the microphones 1, 11, feedback can occur on both sides of the binaural hearing device system. Incoming microphone signals are also directed to a comparison unit 4, 14 in each case. A communication link 10 which is preferably designed to be wireless exists between the comparison units 4, 14. Microphone signals arriving at the respective communication units 4, 14 can be transferred to the other respective comparison unit 14, 4 via this communication connection 10, with the respective signals of the two microphones 1, 11 delivering input signals for the comparison units 4, 14. The comparison units 4, 14 are designed so that, on the basis of a comparison of incoming microphone signals or of signals derived therefrom, they can detect feedback, with the units being able to carry out at least one frequency-selective power comparison of the two microphone signals. In addition algorithms for conducting further comparison operations in the comparison units 4, 14 can be set up. At the heart of the invention lies the fact that the comparison units 4, 14 have the technical capability to generate from the frequency-selective comparison at least one quantitative signal indicating feedback and its frequency, which is done for example by the difference between the spectrums of the two microphone signals being formed, this difference being subjected to an offset correction and being evaluated in relation to a threshold value. The components of the inventive hearing device system to be worn close to the ear also include a control unit 5, 15 to which the quantitative signal generated and indicating the feedback in this manner is directed. The control unit 5, 15 is designed so that in its turn it can generate output signals which can be used to adjust adaptive filter algorithms. The signal paths between the signal processing units 2, 12 and the assigned loudspeakers 3, 13 are divided up in the example below into a number of parallel paths, over which a specific frequency band is transmitted in each case. Integrated into these signal paths are further signal processing units 6, 16, 7, 17, 8, 18 in each case, the action of which is essentially to execute algorithms to suppress feedback. Thus if feedback is detected by the control unit 5, 15 on the basis of the quantitative signal of the comparison unit 4, 14, at least one output signal is generated by the control unit 5, 15 which its turn matches at least one adaptive compensation filter for reducing feedback in order to guarantee an optimum suppression of the feedback. As defined by the invention, the comparison unit 4, 14 and the control unit 5, 15 form means for identifying feedback. These can, as shown in the present example, be supplemented or supported by further means for detecting feedback, especially operated in combination with oscillation detectors 9, 19. The characteristic of the quantitative signal indicating feedback and its frequency output by the comparison unit 4, 14 furthermore offers the advantage that the adaptation of the algorithms contained in the signal processing units 6, 16, 7, 17, 8, 18 can be undertaken rapidly and to a specific end, for example by increasing the threshold values. Mismatches, which would lead for example to an overcompensation for feedback, can be safely avoided in this way.

FIG. 2 through 5 show the spectrums of the microphone signals, with the frequencies in the form of frequency divisions being shown here on the x axis, with the frequency divisions 0 through 60 corresponding to a frequency spectrum of 0 through 10 kHz.

Figure 2:
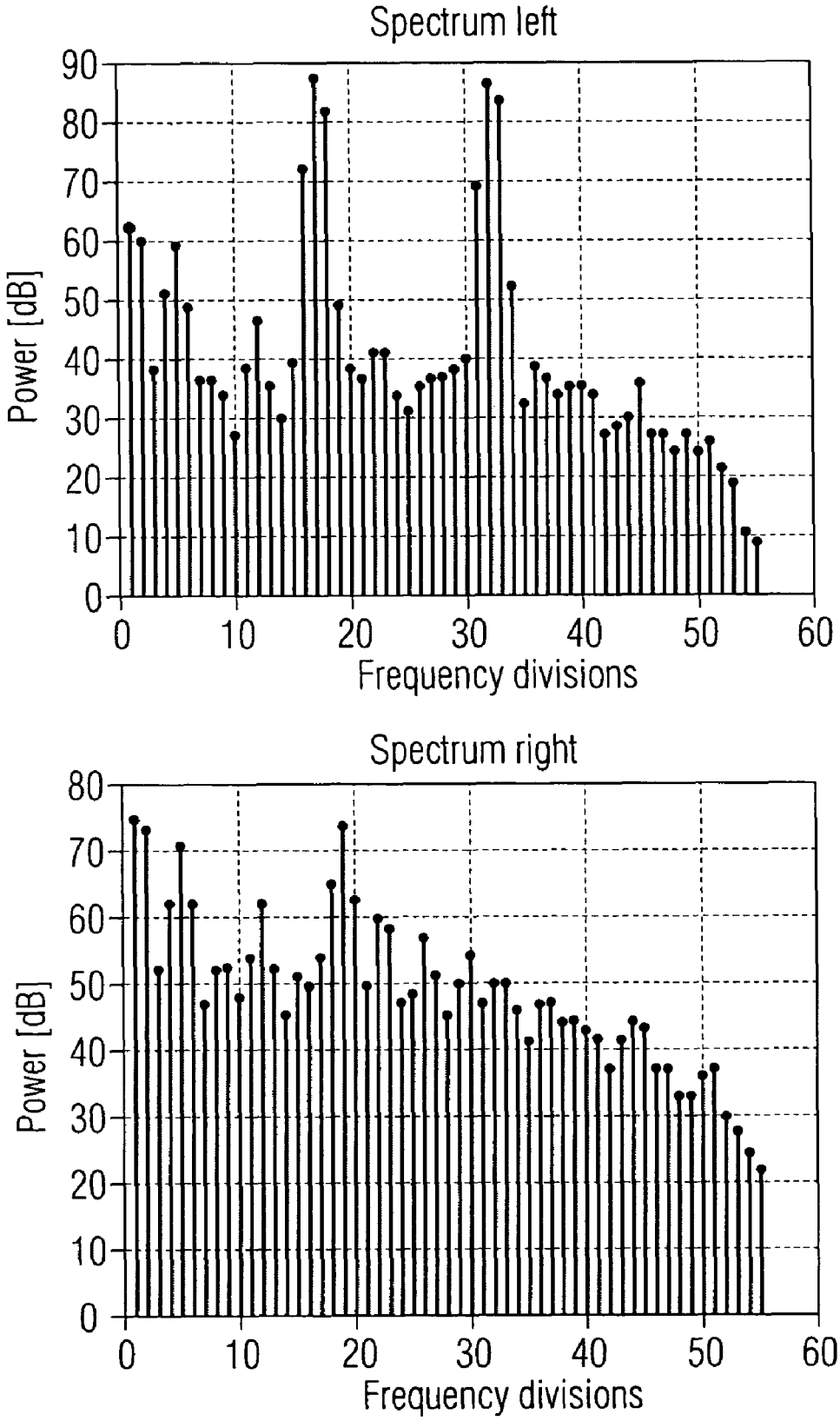
FIG. 2 the spectrums of the microphone signals of the two components of the binaural hearing device system.

FIG. 2 shows the spectrums of the microphone signals of the two components of the binaural hearing device system. In these spectrums the power values are assigned to narrow frequency bands which surround the sampling frequencies in the detection of the spectrums. In this way a quasi-continuous envelope curve is obtained which is a good representation of the frequency curve of the microphone signals which are present which relates to useful signals and feedback in equal measure The basic idea behind the present invention is that feedback, because of its narrowband characteristic can be perceived as peak values in the spectrum, which—provided feedback does not occur on both sides at the same time and at the same frequencies, which is very unlikely—are only to be observed as a marked characteristic on one of the two sides of the binaural hearing device system. Since the two components of the binaural hearing device system have a communication link between them, the spectrums can be swapped which, when using appropriate comparison operations, makes it possible to filter out such peak values, for example by forming a difference between the spectrums, since the spectrums have a strong similarity in other ways. The reason for this similarity is that the two components of a binaural hearing device system are essentially subjected to similar hearing situations which differ only in relation to the alignment of the individual components of the hearing device system to the respective sounds source and associated head shadowing effects. However this head shadowing—depending on the angle of incidence of the sound—causes a power difference between the two spectrums to occur, which is visible in the form of a differing unknown offset which changes over time.

In the present example a situation is shown in which on average higher signal levels are output for almost all analyzed frequencies by the microphone of the right-hand component of the binaural hearing device system. This points to the fact that the source of the received sound is arranged to the right of the hearing device wearer. In the spectrum of the left components, with a basic similarity to the spectrum of the right-hand component, two striking peak values are visible which lie at around 20 frequency divisions and somewhat above 30 frequency divisions. At least the peak value below 20 frequency divisions is able to be verified in weakened form in the spectrum of the right-hand component of the hearing device system. In this case a coherence analysis would establish a high degree of coherence in its frequency range and conclude that this is a sound source which is generating a useful signal which should be amplified accordingly.

A physical explanation of the form of the spectrum shown can however also be supplied on the basis of the occurrence of feedback in the left-hand component of the binaural hearing device system. This feedback is associated as a result of the settings of the left-hand hearing device components with such a high level of whistling that this whistling is detected by the microphone of the right-hand hearing device component and contributes in a significant form to the spectrum of the microphone signal within the right-hand component of the hearing device system without itself leading to feedback. An inventive analysis of the two spectrums allows this case to be unequivocally detected.

Figure 3:
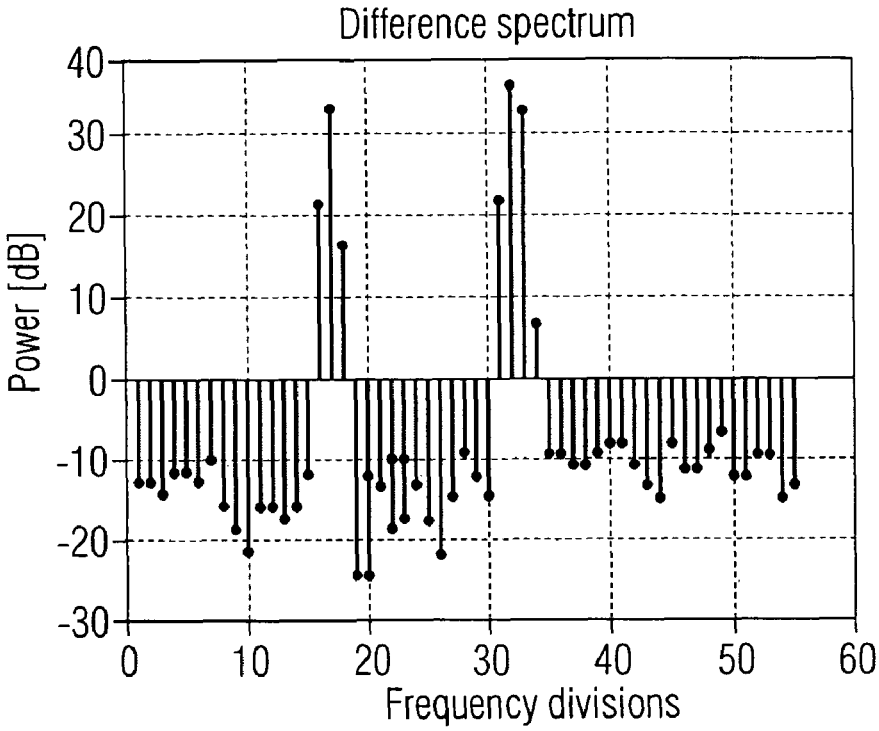
FIG. 3 a differential spectrum of the microphone signals of the two components of the binaural hearing device system.

FIG. 3 shows a differential spectrum of the microphone signals of the two components of the binaural hearing device system with the formation of the difference having been deliberately undertaken so that the spectrum of the right-hand component of the hearing device system has been subtracted from the spectrum of the left-hand component of the hearing device system. Accordingly a negative value of the differential signal is produced in accordance with the hearing situation described in almost all frequency ranges. This trend is only disturbed by the two described peak values at close to 20 frequency divisions and somewhat above 30 frequency divisions.

Since the offset which is identified in the differential spectrum by the predominantly negative values of the differential signal has a wideband character, it can be calculated efficiently by the subtraction of the median of the spectral values and thus does not lead to incorrect detection of feedback.

Figure 4:
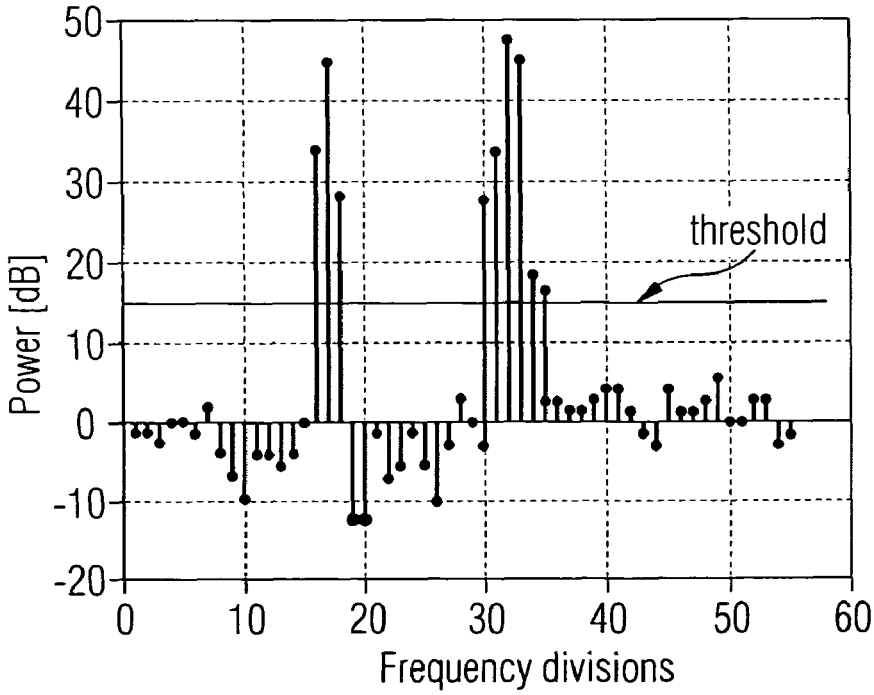
FIG. 4 a differential spectrum of the microphone signals of the two components of the binaural hearing device system cleaned up by offset correction.

FIG. 4 shows a differential spectrum of the microphone signals of the two components of the binaural hearing device system cleaned up by the offset correction just described. In this cleaned-up spectrum the two peak values appear even more clearly at around 20 frequency divisions and slightly above 30 frequency divisions. This makes it possible to define a threshold value above which in the differential spectrum it can be assumed that feedback is present.

Figure 5:
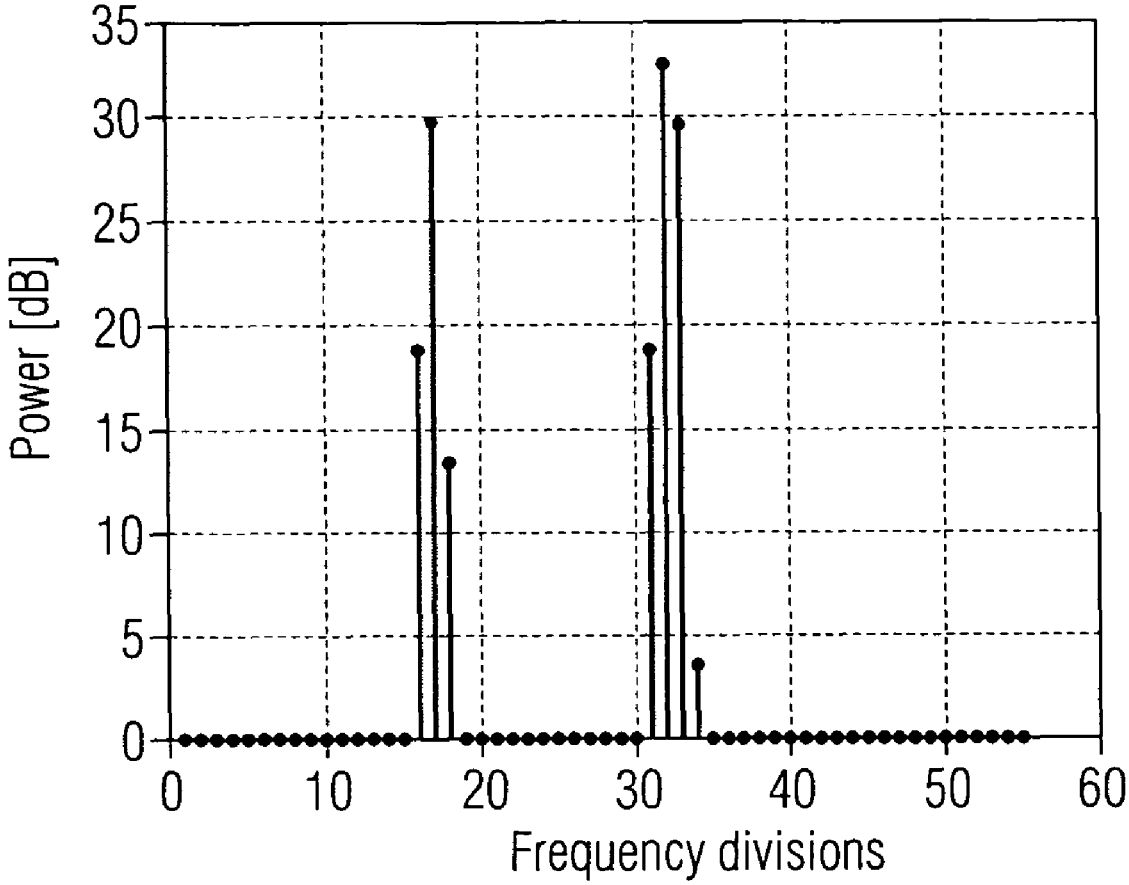
FIG. 5 a differential spectrum of the microphone signals of the two components of the binaural hearing device system cleaned up by a threshold value comparison.

FIG. 5 shows a differential spectrum of the microphone signals of the two components of the binaural hearing device system cleaned up by a threshold value comparison. All values lying below the threshold value within the differential spectrum are set to zero whereas the values lying above the threshold value are output in accordance with the actual power difference determined in the respective frequency range. With a suitable selection of the threshold value each peak of a differential spectrum cleaned up in this way can thus be evaluated as a safe indication for the occurrence of feedback and can be used for initiating the appropriate suppression mechanisms in order to quickly and safely prevent the occurrence of feedback.

The inventive difference signal generated by the evaluation of the spectrums provides the opportunity of spectrally-selective recognition of feedback and at the same time forms a quantitatively evaluatable parameter which can be incorporated in different ways into controls of automatic algorithms for feedback suppression. For example the adaptation speed of an adaptive method for feedback suppression (frequency domain NLMS algorithm) can be briefly selectively increased for the frequency components in the frequency range in which corresponding feedback has been detected. Since the security of detection for feedback is a very good and the increase in the adaptation speed is only undertaken selectively, practically no audible signal distortion occurs.

The inventively-generated difference signal can also be used to increase the attenuation of frequency components in which feedback is detected, with this being done to the precise extent required to make the feedback disappear. Compared to the use of notch filters this offers the advantage that no frequency is completely eliminated. The quantitative expressive content of the frequency-dependent difference signal is also a significant advantage for automatic adaptation of the attenuation characteristics.

A combination of the two methods is also possible and leads to a rapid suppression of feedback without a useful signal distortions.

Since smoothed power estimations between the hearing devices can be compared with the method which can be heavily undersampled, a high level of secure detection can be achieved even at a data rate of the order of magnitude of 1 kBit/sec, which can be reduced even further by effective encoding. This too is an advantage compared to methods for suppressing feedback based on coherence analyses in which the unprocessed and unsmoothed spectral values must be exchanged, on the basis of which the coherence is then determined. A significantly higher data rate is necessary for this.

The advantage of the invention lies in the opening up of a robust binaural method for a feedback suppression which is based on the comparison of the spectral powers of the hearing device components on both sides the head. The detection of feedback can for example be used both for adaptation control and also for short-term selective attenuation. This ensures that feedback is effectively suppressed.

The invention is not restricted to the exemplary embodiments shown that can be expanded by a plurality of variants. For example more than two microphone signals can be compared with each other to detect feedback. Furthermore the signal processing can be undertaken in a hearing device system in accordance with the invention in parallel in a number of channels of the signal processing units. The comparison of microphone signals or the generation of a quantitative signal indicating feedback and its frequency by frequency-selective power comparison can then likewise be undertaken in parallel in a number of channels. Measures to reduce detected feedback are then advantageously likewise restricted to only the channels concerned. In addition the inventive frequency-selective power comparison of microphone signals can be undertaken continuously or only for a time as a function of specific parameters, for example as a function of a hearing program set or of the current volume setting of the hearing device system.

The invention claimed is:

1. A method for operating a hearing device system, comprising:

providing at least two microphones arranged spatially separated from one another;

providing sound-generating output units assigned to these microphones, in which, by comparing the microphone signals or signals derived therefrom, feedback can be detected and on detection of the feedback measures can be initiated for reducing the feedback; and conducting a frequency-selective power comparison for the comparison of the microphone signals or the signals derived therefrom, wherein at least one quantitative signal indicating feedback and its frequency is generated by the frequency-selective power comparison, and wherein the frequency-selective power comparison is executed by the difference is formed between the spectrums of the two microphone signals, wherein this difference is subjected to an offset correction and evaluated in relation to a threshold value.

2. The method as claimed in claim 1, wherein the quantitative signal indicating the feedback and its frequency is used to set at least one algorithm for suppressing feedback.

3. The method as claimed in claim 2, wherein a step width for the setting of the algorithm for suppressing feedback is derived from the quantitative signal indicating feedback and its frequency.

4. The method as claimed in claim 1, wherein at least one adaptive compensation filter for reducing feedback is used which is adapted when feedback is detected.

5. The method as claimed in claim 4, wherein the adaptation of the adaptive compensation filter is undertaken automatically using the quantitative signal indicating the feedback and its frequency.

6. The method as claimed in claim 4, wherein at least one microphone signal is investigated for the presence of oscillations.

7. The method as claimed in claim 1, wherein the hearing device amplification is reduced if feedback is detected.

8. The method as claimed in claim 1, wherein the signal processing is undertaken in a number of parallel channels and wherein on detection of feedback at least one algorithm is used for suppressing feedback in the channel in which the feedback is occurring.

9. A hearing device system, comprising:

at least two microphones arranged spatially separated from one another;

sound-generating output units assigned to these microphones;

units to detect feedback from a comparison of the microphone signals or signals derived therefrom, wherein on detection of the feedback measures for reducing the feedback are initiated;

units to compare the microphone signals or the signals derived, wherein a frequency-selective power comparison is provided, wherein through the frequency-selective power comparison at least one quantitative signal indicating a feedback and its frequency is generated, and wherein devices are provided to execute frequency-selective power comparisons by forming the difference of the spectrums of the two microphone signals, subjecting this difference to an offset correction and evaluating it in relation to a threshold value.

10. The hearing device system as claimed in claim 9, wherein devices are provided to evaluate the quantitative signal indicating the feedback and its frequency in order to set at least one algorithm for suppressing feedback.

11. The hearing device system as claimed in claim 10, wherein devices are provided to derive from the quantitative signal indicating feedback and its frequency a step width for setting an algorithm for suppressing feedback.

12. The hearing device system as claimed in claim 9, wherein at least one arrangement is present which operates as an adaptive compensation filter for reducing feedback which is adapted on detection of feedback.

13. The hearing device system as claimed in claim 12, wherein devices are provided which effect an automatic adaptation of at least one adaptive compensation filter using the quantitative signal indicating the feedback and its frequency.

14. The hearing device system as claimed in claim 9, wherein at least one microphone signal is investigated for the presence of oscillations.

15. The hearing device system as claimed in claim 9, wherein the hearing device amplification is reduced if feedback is detected.

16. The hearing device system as claimed in claim 9, wherein comparison units are included in the components of the hearing device system which exchange data with each other via a communications link, or wherein the comparison units are included in the components of the hearing device system which exchange data with each other via a wireless communication link.

* * * * *